US006260509B1

(12) United States Patent
Aslam et al.

(10) Patent No.: US 6,260,509 B1
(45) Date of Patent: Jul. 17, 2001

(54) TEXTURED PHOTOGRAPHIC PRINTS RESISTANT TO HANDLING HAZARDS

(75) Inventors: Muhammed Aslam, Rochester; Robert D. Bobo, Ontario, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/198,974

(22) Filed: Nov. 24, 1998

(51) Int. Cl.[7] ..... B05C 1/04

(52) U.S. Cl. ..... 118/45; 118/60; 118/101; 118/106; 118/202; 118/257; 118/DIG. 1

(58) Field of Search ..... 118/45, 60, 76, 118/101, 106, 257, DIG. 1, 202; 427/189, 194, 195, 429, 278, 366; 156/277, 279; 101/416.1, 417, 418, 424.2; 430/961; 399/342

(56) References Cited

U.S. PATENT DOCUMENTS

| | | | | |
|---|---|---|---|---|
| 3,385,722 | * | 5/1968 | Weaver et al. | 427/194 |
| 4,779,558 | * | 10/1988 | Gabel et al. | 118/46 |
| 4,893,740 | | 1/1990 | Hediger et al. | 226/23 |
| 5,019,869 | | 5/1991 | Patton | 399/320 |
| 5,023,038 | | 6/1991 | Aslam et al. | 264/293 |
| 5,085,962 | | 2/1992 | Aslam et al. | 430/99 |
| 5,118,589 | | 6/1992 | Aslam et al. | 430/124 |
| 5,249,949 | | 10/1993 | Aslam et al. | 425/385 |
| 5,337,132 | | 8/1994 | Cherian | 379/342 |
| 5,339,146 | | 8/1994 | Aslam et al. | 399/342 |
| 5,357,326 | | 10/1994 | Cherian | 399/328 |
| 5,392,104 | | 2/1995 | Johnson | 399/501 |
| 5,476,043 | * | 12/1995 | Okuda et al. | 118/46 |
| 5,670,237 | * | 9/1997 | Shultz et al. | 427/366 |
| 5,804,341 | | 9/1998 | Bohan et al. | 430/12 |

* cited by examiner

*Primary Examiner*—Laura Edwards
(74) *Attorney, Agent, or Firm*—Lawrence P. Kessler

(57) ABSTRACT

Apparatus for selectively providing textured handling hazard resistant clear marking particles coatings to photographic elements on an elongated web transported along a travel path from a supply roller to a take-up roller. The apparatus includes a device, located in operative association with the web travel path for applying a clear marking particle coating to the web. A heated fuser roller and a mechanism, such as a pressure roller providing a nip relation with the fuser roller for travel of the web through the nip, are located relative to the web travel path to fuse the clear marking particle coating to the web. At least one heated, textured roller, is located downstream of the fuser roller relative to the web travel path facing the photographic elements on the web. A mechanism is provided for urging a preselected one of the heated, textured rollers into pressure contact with the web for transferring such texture of the roller to the clear marking particle coating while the coating is in a softened state due to heat from the heated, textured roller.

10 Claims, 1 Drawing Sheet

TEXTURED PHOTOGRAPHIC PRINTS RESISTANT TO HANDLING HAZARDS

FIELD OF THE INVENTION

This invention is directed in general to an apparatus for applying protective coatings to photographic elements, and more particularly to an apparatus for applying selectively varied textured hazard resistant clear marking particle coatings to photographic elements.

BACKGROUND OF THE INVENTION

In color photographic elements, a dye image is formed as a consequence of silver halide development by one of several different processes. The most common is to allow a by-product of silver halide development, oxidized silver halide developing agent, to react with a dye-forming compound called a coupler. The silver and unreacted silver halide are then removed to form the photographic element, leaving a dye image.

Such formation of a dye image commonly involves liquid processing with aqueous solutions that must penetrate the surface of the element to come into contact with silver halide and coupler. Thus, gelatin, and similar natural or synthetic hydrophilic polymers, have proven to be the binders of choice for silver halide photographic elements. Unfortunately, when gelatin, and similar polymers, are formulated so as to facilitate contact between the silver halide crystal and aqueous processing solutions, they are not as tough and mar-resistant as would be desired for something that is handled in the way that an imaged photographic element may be handled. Thus, the imaged element can be easily marked by finger elements, it can be scratched or torn and it can swell or otherwise deform when it is contacted with liquids.

Various techniques have been suggested to protect photographic elements from physical damage. One is to apply to the surface of the developed photographic element a preformed layer of a polymer more physically robust than gelatin, for example by lamination. Another is to apply to the surface of the developed element a liquid composition which is cured to leave a tough polymer layer. Unfortunately, these techniques for protecting the surface of a photographic element suffer from one or more problems.

Lamination has several disadvantages. For example, lamination involves an added expense associated with coating an additional support. Also, it is susceptible to trapping pockets of air between the laminate and the element during the laminating step leading to image defects. Moreover, because the laminate is self-supporting before lamination, it is thicker than necessary, which is wasteful of materials and can cause the element to curl if it is applied to only one side of the element. Application of a liquid overcoat can avoid some of the problem associated with lamination, such as formation of air pockets. But it introduces other problems. For example, handling the liquid compositions can be messy and such compositions often contain environmentally undesirable solvents. Moreover, liquid coatings can be difficult to dry or can require a separate UV curing step.

Electrophotography entails forming an electrostatic charge pattern on a surface and then forming a pattern of a marking composition, called a marking particles, on that surface as a function of the location of the charge pattern. The resulting pattern of marking particles is made permanent on an image bearing surface by application of heat and/or pressure to cause the marking particles to fuse and adhere to the image bearing surface. It has been suggested from time to time to overcoat such marking particle patterns in various ways, such as with a clear marking particles to form a protective overcoat on a marking particles image. In U.S. Pat. No. 5,804,341 (issued Sep. 8, 1998, in the names of Bohan et al), it has been suggested to use electrostatic or electrophotographic technology to apply a protective overcoat to images derived from silver halide photographic elements.

This would provide a protective overcoat to imaged photographic elements by a simple dry technique that gives easily applied, relatively thin overcoat layers. It has been found that electrophotographic marking particle compositions can adhere to the hydrophilic surface of a photographic element and protect the surface of the image during normal handling. That is, an imaged photographic element, comprising a silver halide derived image in a hydrophilic binder, has in the presence of an electric field, charged, clear polymeric particles are applied to a major surface of the element, so as to cause the particles to adhere to the surface of the element. The clear polymeric particles are fused so as to cause them to form a continuous polymeric layer on the surface of the element. The thin protective overcoat for the picture elements is a clear electrophotographic marking particle polymer. However, the protected photographic elements have been limited, in surface finish to one gloss condition, usually a high gloss finish.

SUMMARY OF THE INVENTION

In view of the above, this invention is directed to apparatus for selectively providing textured handling hazard resistant clear marking particle coatings to photographic elements on an elongated web transported along a travel path from a supply roller to a take-up roller. The apparatus includes a device, located in operative association with the web travel path for applying a clear marking particle coating to the web. A heated fuser roller and a mechanism, such as a pressure roller providing a nip relation with the fuser roller for travel of the web through the nip, are located relative to the web travel path to fuse the clear marking particle coating to the web. At least one heated, textured roller is located downstream of the fuser roller relative to the web travel path facing the photographic elements on the web. A mechanism is provided for urging a preselected one of the heated, textured rollers into pressure contact with the web for transferring such texture of the roller to the clear marking particle coating while the coating is in a softened state due to heat from the heated, textured roller.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
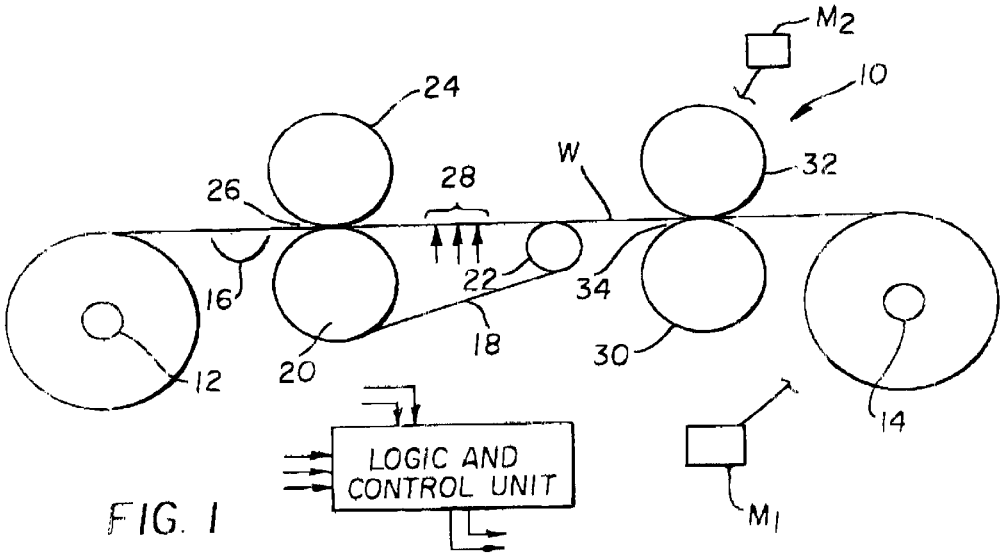
FIG. 1 is a schematic illustration of an apparatus, according to this invention, utilized to selectively provide desired textured handling hazard resistant clear marking particle coatings to photographic elements.

Referring now to the accompanying drawings, FIG. 1 shows an apparatus, designated generally by the numeral 10, for providing protective coatings, resistant to handling hazards, to photographic picture elements on an elongated web of support material. The elongated web, designated as W, is threaded between a supply roll 12 and a take-up roll 14. A suitable device, such as a schematically illustrated motor $M_1$, selectively rotates the take-up roll 14 in order to transport the web W along a travel path to the take-up roll from the supply roll.

The apparatus 10 includes a development station 16 in operative relation to the web W for providing a protective coating on the web as it is transported along the travel path. The development station 16 includes a reservoir for clear marking particles, and a suitable mechanism for applying a thin coating of such clear marking particles to the web. The applying mechanism may be any well known marking particle developer device, such as a magnetic brush developer station. The thin coating applied to the web, once fused as described below, serves to protect photographic elements on the web from handling hazards.

The apparatus 10 further includes a fusing belt 18 entrained about a heated fusing roller 20 and a steering roller 22 (more fully described in U.S. patent application Ser. No. 08/992,056, filed Dec. 17, 1997, now U.S. Pat. No. 5,895,153), for movement in a predetermined direction about a closed loop path. The fusing belt 18 is, for example, a thin metallic or heat resistant plastic belt. Metal belts can be electroformed nickel, stainless steel, aluminum, copper or other such metals, with the belt thickness being about 2 to 5 mils. Seamless plastic belts can be formed of materials such as polyimide, polypropylene, or the like, with the belt thickness summarily being about 2 to 5 mils. Usually these fusing belts are coated with thin hard coatings of release material such as silicone resins, fluoropolymers, or the like. The coatings are typically thin (1 to 10 microns), very smooth, and shiny. Such fusing belts could also be made with some textured surface to produce images of lower gloss or texture.

A pressure roller 24 is located in nip relation with the heated fusing roller 20. The nip 26 between the fuser roller and the pressure roller provides for passage of the web as the web is transported along its travel path. A flow of air is directed at the area 28 of the belt run upstream of the steering roller 22 and adjacent to the steering roller to cool such area. The cooling action provides for a commensurate cooling of the web W, bearing the photographic elements and clear marking particle coating, while such member is in contact with the fusing belt 18. The cooling action for the web serves as the mechanism to substantially prevent offset of the marking particle coating.

Figure 2:
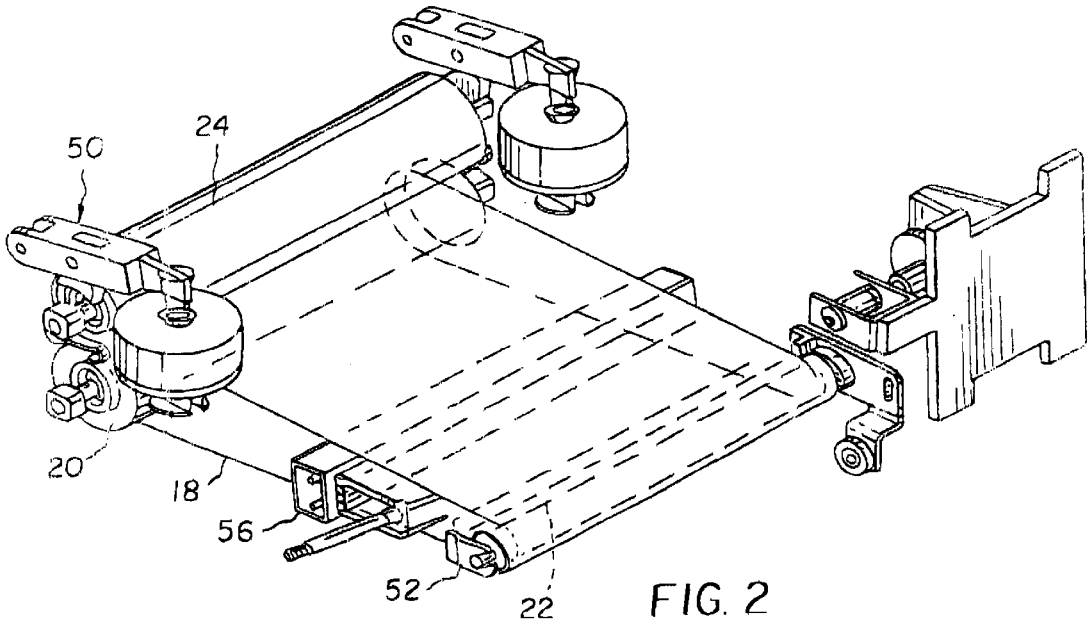
FIG. 2 is a view, in perspective, of a portion of the belt fusing apparatus and the belt tracking control mechanism of the apparatus according to this invention, with portions removed to facilitate viewing.

The belt fusing apparatus is mounted in operative association with a belt tracking control mechanism. The belt tracking control mechanism, designated generally by the numeral 50, is best shown in FIG. 2. The steering roller 22 is supported in a yoke 52 for rotation about the longitudinal axis of the steering roller. The yoke 52 is urged, for example by a compression spring (not shown) in a direction away from the fuser roller 20 in order to maintain a predetermined tension on the fuser belt 18. The yoke 52 is mounted in a cantilever fashion from a frame 56, in any suitable manner, to provide for castering and gambling movement of the steering roller 22 with the yoke. One suitable mounting arrangement for use with this invention is shown in U.S. Pat. No. 4,893,740, issued Jan. 16, 1990, in the names of Hediger et al.

The web W, as well as the fuser belt 18, must be controlled for accurate tracking to prevent damage to the photographic elements. As such, the receiver supply roll 12 is gimbaled and steered in a similar fashion to that of the fusing belt tracking control mechanism 50, as described above, to keep the web W aligned and tracked with the fusing belt 18. The lateral edge position of the web W can also be sensed with respect to the fusing belt 18, and accordingly a feedback signal sent to the web steering device to correct the web position. Another way of keeping the web W in line with the fusing belt 18 would be to gimbal the web supply roll 12 to provide required tension, and steer the web with a guide which is aligned with the fusing belt.

Appropriate sensors (not shown) of any well known type, such as mechanical, electrical, or optical sensors for example, are utilized to provide control signals for the apparatus 10. Such sensors are located along the web travel path and are associated with the various process stations of the apparatus 10. As such, the sensors detect the location of the web W in its travel path, and produce appropriate signals indicative thereof. Such signals are fed as input information to a logic and control unit including a microprocessor, for example. Based on such signals and a suitable program for the microprocessor, the logic and control unit produces signals to control the timing operation of the various electrographic process stations for carrying out the reproduction process. The production of a program for a number of commercially available microprocessors, which are suitable for use with the invention, is a conventional skill well understood in the art. The particular details of any such program would, of course, depend on the architecture of the designated microprocessor.

When textures for the photographic elements, other than high gloss, are desired, additional rollers are provided according to this invention. The additional rollers, designated by the numerals 30, 32 in FIG. 1, are located immediately down stream of the fusing apparatus 10. The rollers 30, 32 are selectively urged into operative engagement to form a nip 34 only when the textured finish is desired. Such nip-forming, operative association, may be provided by any suitable mechanism, such as a motor $M_2$ schematically illustrated in FIG. 1. The roller 30 is a heated roller, while the roller 32 is a pressure roller. The heated roller 30 is metallic (aluminum, steel, or any other suitable thermally conductive hard material), and has a desired textured outer surface. A variety of surface textures for the roller 30 may be provided upon roller construction by suitable preselected mechanical devices, such as chill rollers for example. As such, a plurality of interchangeable rollers, having different respective textured surfaces may be provided. The textured rollers are thus interchangeable, with one being preselected, for use as roller 30, according to the desired texture of the photographic elements being processed. Of course, a plurality of rollers with different respective surface textures could be arranged, for example on a turret device which is selectively rotated to bring a desired roller (and particular texture surface) into operative relation with the photographic elements being processed. The pressure roller 32 has a metal core with a thin elastomeric coating so as to provide a working nip with the roller 30.

The roller 30 is heated to a temperature equal to, or just below, the glass transition temperature of the marking particles in the clear marking particle layer such that under sufficient pressure, the marking particle layer softens. The marking particle layer will then adopt the texture of the surface of the roller 30 while maintaining its cohesive strength to release from the textured roller 30 without any offset to the roller. Further, the textured roller 30 could also be coated with a very thin hard layer of some low surface energy material (such as silicon resins or fluoro polymers, for example). Accordingly, no release oil (as utilized on the fusing roller) would be required.

The invention has been described in detail with particular reference to certain preferred embodiments thereof, but it will be understood that variations and modifications can be effected within the spirit and scope of the invention.

What is claimed is:

1. Apparatus for selectively providing textured handling hazard resistant clear marking particle coatings to photographic elements on an elongated web transported along a travel path from a supply roller to a take-up roller, said apparatus comprising:

a device, located in operative association with said web travel path, for applying a clear marking particle coating to said web;

a heated fuser roller;

a mechanism for urging said web into operative association with said fuser roller to fuse said clear marking particle coating to said web;

at least one heated, textured roller, located downstream of said fuser roller relative to said web travel path facing said photographic elements on said web; and a mechanism for urging a preselected one of said heated, textured rollers into pressure contact with said web for transferring such texture of said heated, textured roller to said clear marking particle coating while said coating is in a softened state due to heat from said heated, textured roller.

2. The apparatus of claim 1 wherein said heated, textured roller is heated to a temperature substantially at or just below the glass transition of said clear marking particles.

3. The apparatus of claim 2 wherein said at least one heated, textured roller includes a plurality of rollers respectively having differing surface textures.

4. The apparatus of claim 2 wherein said mechanism urging said preselected one of said heated, textured rollers into pressure contact with said web includes a pressure roller, located relative to said web on the opposite side of said web travel path from said heated, textured roller, said pressure roller being selectively brought into operative association with said heated, textured roller to form a pressure nip therebetween.

5. The apparatus of claim 1 wherein said mechanism for urging said web into operative association with said fuser roller includes a pressure roller located relative to said web travel path to provide a nip relation with said fuser roller for travel of said web through said nip.

6. The apparatus of claim 1 wherein said device for applying a clear marking particle coating to said web is a magnetic brush development station.

7. Apparatus for selectively providing textured hazard resistant clear marking particle coatings to photographic elements on an elongated web transported along a travel path from a supply roller to a take-up roller, said apparatus comprising:

a device, located in operative association to said web travel path for applying a clear marking particle coating to said web;

a heated fuser roller;

a pressure roller located relative to said web travel path to provide a nip relation with said fuser roller for travel of said web through said nip to fuse said clear marking particle coating to said web;

a steering roller;

a fusing belt entrained about said fuser roller and said steering roller for movement in a predetermined direction about a closed loop path;

a mechanism for accurately controlling the tracking of said fusing belt;

a plurality of heated, textured rollers, said heated, textured rollers respectively having differing surface textures; and a mechanism for urging a preselected one of said heated, textured rollers into pressure contact with said web, downstream of said steering roller relative to said web travel path facing said photographic elements on said web, for transferring such texture of said heated, textured roller to said clear marking particle coating while said coating is in a softened state due to heat from said roller.

8. The apparatus of claim 7 including a mechanism for accurately controlling the tracking of said elongated web.

9. The apparatus of claim 8 wherein said heated, textured roller is heated to a temperature substantially at or just below the glass transition of said clear marking particles.

10. The apparatus of claim 9 wherein said mechanism urging said preselected one of said heated, textured rollers into pressure contact with said web includes a pressure roller, located relative to said web on the opposite side of said web travel path from said heated, textured roller, said pressure roller being selectively brought into operative association with said heated, textured roller to form a pressure nip therebetween.

* * * * *